US008015631B2

(12) United States Patent
Pesta

(10) Patent No.: US 8,015,631 B2
(45) Date of Patent: Sep. 13, 2011

(54) SAFETY ENCLOSURE COVER FOR PORTABLE INFLATABLE POOL

(75) Inventor: LeeAnn Pesta, West Babylon, NY (US)

(73) Assignee: Pool Cover Corporation, Hauppauge, NY (US)

( * ) Notice: Subject to any disclaimer, the term of this patent is extended or adjusted under 35 U.S.C. 154(b) by 264 days.

(21) Appl. No.: 12/383,287

(22) Filed: Mar. 23, 2009

(65) Prior Publication Data

US 2010/0235979 A1 Sep. 23, 2010

(51) Int. Cl.
*E04H 4/10* (2006.01)

(52) U.S. Cl. ..... 4/499; 4/498; 4/503; 52/2.11; 52/23; 52/82; 220/216; 150/154

(58) Field of Classification Search ..... 4/498, 499, 4/503; 5/414, 417–419; 52/2.11, 2.25, 3, 52/23, 82, DIG. 12; 220/213, 216; 210/DIG. 9; 150/154
See application file for complete search history.

(56) References Cited

U.S. PATENT DOCUMENTS

| | | | | |
|---|---|---|---|---|
| 3,355,745 | A * | 12/1967 | Jannuzzi | 4/503 |
| 3,366,977 | A * | 2/1968 | Koehler | 4/499 |
| 3,474,803 | A | 10/1969 | Davis | |
| 4,315,535 | A | 2/1982 | Battle | |
| 4,332,112 | A * | 6/1982 | Hsu | 52/2.21 |
| 4,685,254 | A * | 8/1987 | Terreri | 52/2.26 |
| 4,847,925 | A * | 7/1989 | Perry | 4/499 |
| 5,566,512 | A * | 10/1996 | Page | 52/2.16 |
| 5,921,389 | A | 7/1999 | Zoffer | |
| 5,924,144 | A | 7/1999 | Peterson | |
| 5,987,661 | A | 11/1999 | Peterson | |
| 6,052,843 | A * | 4/2000 | Pirillo | 4/498 |
| 6,286,157 | B1 | 9/2001 | Baumann | |
| 6,539,559 | B1 | 4/2003 | Creech | |
| 6,691,334 | B2 | 2/2004 | St-Hilare | |
| 7,874,023 | B1 * | 1/2011 | Sundling | 4/499 |
| 2005/0108818 | A1 | 5/2005 | Cordray | |
| 2005/0171812 | A1 * | 8/2005 | Garfinkle et al. | 705/1 |
| 2007/0226889 | A1 | 10/2007 | Pesta | |
| 2009/0151065 | A1 * | 6/2009 | Watson | 4/503 |
| 2009/0158517 | A1 * | 6/2009 | Herd et al. | 4/499 |

FOREIGN PATENT DOCUMENTS

EP 2 017 406 * 1/2009

* cited by examiner

*Primary Examiner* — Robert J Canfield
(74) *Attorney, Agent, or Firm* — Alfred M. Walker

(57) ABSTRACT

A safety enclosure cover for a portable air-inflatable swimming pool includes a mat spread on a horizontal surface, with the inflatable pool resting on the mat. An outer rim of the mat extends beyond an outer wall of the inflatable pool. Water is filled into the inflatable pool so that an inflated holding pillow floats on an upper surface of said water. A cover encloses the inflatable pool and the floating holding pillow. An outer edge of the cover is attached to an outer edge of the mat whereby the water and inflatable pool are completely enclosed, so that the floating pillow pushes up on the inside of the cover, thereby the cover is formed into a convex shape so that rainwater is shed from the convexly-shaped cover.

19 Claims, 4 Drawing Sheets

SAFETY ENCLOSURE COVER FOR PORTABLE INFLATABLE POOL

FIELD OF THE INVENTION

The present invention relates to safety enclosure covers for portable inflatable backyard pools which lack rigidity, whereby the cover assumes a convex shape to direct rainwater off of the cover.

BACKGROUND OF THE INVENTION

A portable pool is a pool that can be inflated (or blown up) and filled with water. In addition, the pool can be moved from one place to another when it is not filled with water. There may or may not be any side supports for the pool. The pool is intended for seasonal use only and is taken down during the non-season, typically winter.

Although holding less water than a larger permanent pool, a portable pool is still a drowning hazard for persons (especially small children) or animals such as household pets.

OBJECTS OF THE INVENTION

It is therefore an object of the present invention to provide a safety enclosure cover for a portable inflatable backyard pools which lacks rigidity, whereby the cover assumes a convex shape to direct rainwater off of the cover.

SUMMARY OF THE INVENTION

The current invention is to be used in such a fashion as to prevent access of a child or animal to the pool water, thereby reducing the risk of drowning. The safety enclosure cover of this invention is a unit that when fastened as required, completely engulfs the pool. The cover consists of a ground mat that is laid down upon the surface where the pool is to be used. The portable pool is then placed on the ground mat; it is then inflated and filled with water. When the pool is not in use, the second piece, a top cover is placed on top of the pool. The two pieces are then secured together via a zipper. The zipper goes around the whole perimeter of the pool, and is then secured from opening via a cable lock.

To prevent the accumulation of water atop the safety enclosure cover, a vinyl air holding pillow is attached to the underside of the top piece of the top cover. The pillow is inflated after the top cover is placed upon the pool and secured in place as described above. An air line is attached to a fill valve (with integral check valve) on the outer surface of the top cover and is in communication with the air pillow within. When inflated, this pillow floats on the water inside the pool thereby spacing the top cover from the water surface. This causes the top cover piece to rise up presenting a convex outer shape which sheds any rain water thus preventing accumulation. The pillow allows for the elimination of blind spots, as the center of the cover is raised far above the rim of the pool.

The safety enclosure cover can be removed by opening the cable lock, unzipping the top cover from the ground mat, and then removing the top cover to gain access to the pool. The ground mat is kept in place during use.

In an alternate embodiment, the air pillow is separate from the top cover. (A large spherical inflatable ball can also be used instead.) In this method, the pillow or ball is inflated (or stored as inflated) and placed inside the pool to float on the water surface before the top cover is placed on top of the pool and secured to the ground mat.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

The safety enclosure cover of this invention is made of sturdy material using efficient fabrication techniques. Although other material may be substituted, the preferred fabric is a waterproof laminated PVC with a reinforcement scrim; it is approximately 0.011" thick. The attachment of the various panels is accomplished by the use of RF machines (radio frequency heat sealing); an ultrasonic bonding technique can be used as well, while stitching is less desirable.

Figure 1:
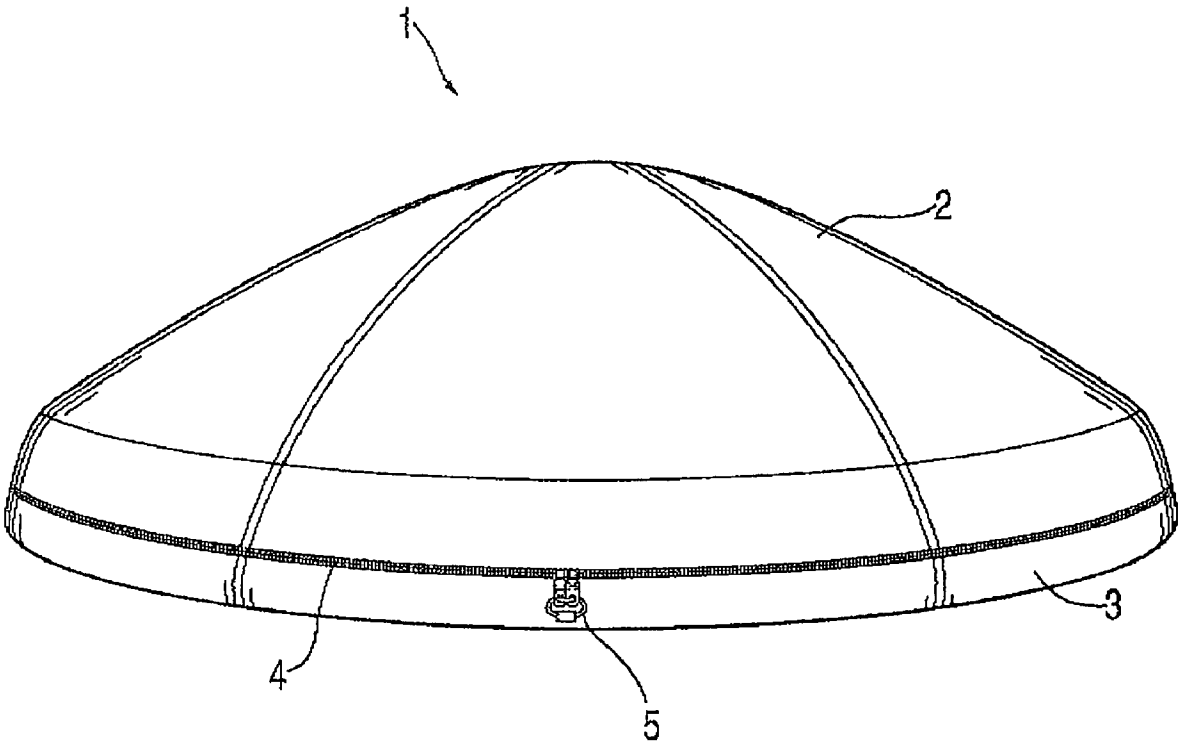
FIG. 1 is a perspective view of the safety enclosure cover of this invention installed on a portable pool.

FIG. 1 shows safety enclosure cover 1 with ground mat 3, top cover 2, zipper 4 which attaches the two, and cable lock 5 which secures zipper 4. Note the convex shape of top cover 2 which would shed any rain water over the sides of the pool. Zipper 4 is preferably a nylon zipper. Cable lock 5 is preferably a key lock with a removable key, or it may be a combination lock.

Figure 2:
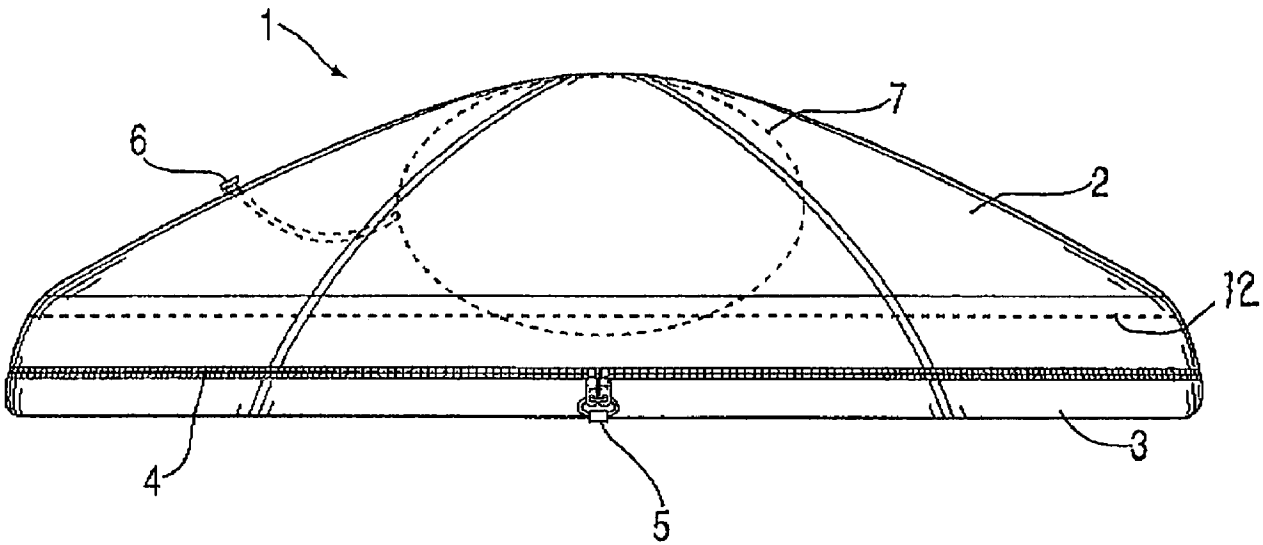
FIG. 2 is a side elevation of the safety enclosure cover as installed on a pool showing the various parts.

FIG. 2 is a side view of the safety enclosure cover 1 of FIG. 1 also indicating the water level 12 inside the pool. Attached air pillow 7 enclosed by top cover 2 is shown in dashed lines floating on the pool water. Pillow 7 is inflated via fill valve 6 on the outer surface of the dome section 11 of top cover 2. The side section 8 of top cover 2 is also shown.

Figure 3:
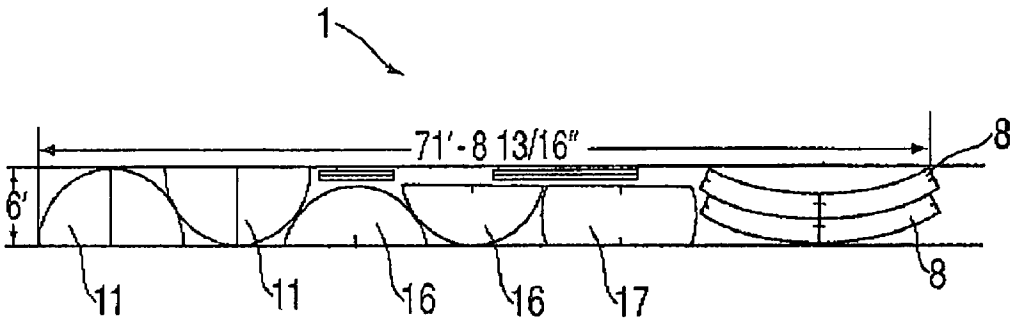
FIG. 3 is a top view of the pattern plan for cutting panels of reinforced PVC fabric to construct a safety enclosure cover of this invention.

FIG. 3 is a pattern showing how all of the fabric sections for a safety enclosure cover for a nominal 12' diameter portable pool would be cut out of a single strip of 6' wide fabric under 72' long.

Figure 4:
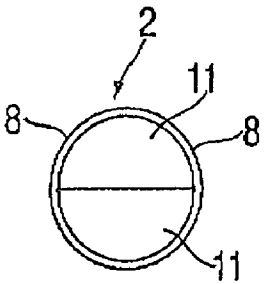
FIG. 4 is a top view of the top cover showing the panels used from FIG. 3.

FIG. 4 is a top view of top cover 2 showing how the dome section 11 is made from two panels 11 from FIG. 3 attached to strips 8 forming the side section 8.

Figure 5:
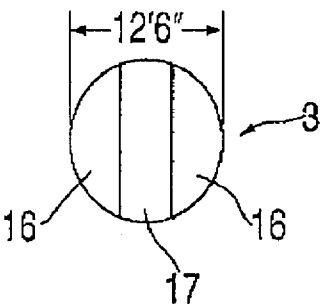
FIG. 5 is a top view of the ground mat as fabricated from three panels of FIG. 3.

Similarly, two panels 16 along with panel 17 are used to create the ground mat 3 as shown in FIG. 5.

Figure 6:
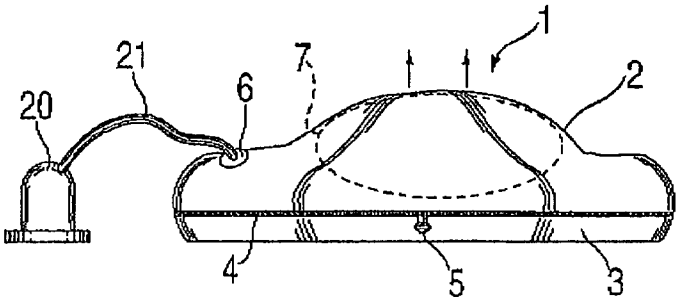
FIG. 6 is a side elevation of the safety cover during the inflation phase of the attached air pillow.

FIG. 6 is a side view of the attached air pillow being inflated in situ by compressor or air pump 20 via air line 21 connected to fill valve 6 on top cover 2. The dome section of top cover 2 is being raised by the internal air pillow 7. Fill valve 6 is on a screw cap which can be removed to deflate air pillow 7. Air compressor or air pump 20 can be the same unit used to inflate the portable pool.

Figure 7:
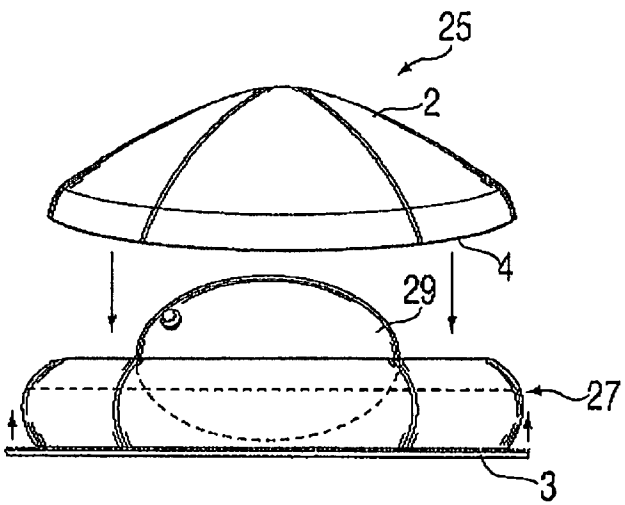
FIG. 7 is a side view illustrating the method of the alternate embodiment using a separate inflatable pillow.

FIG. 7 shows the method of the alternate embodiment 25 wherein air pillow 29 is separate from top cover 2. It is pre-inflated and placed to float atop the water in pool 27 prior to attachment of top cover 2 to ground mat 3. After top cover 2 is placed atop pillow 29 and centered, it is attached to ground mat 3 via zipper 4 and secured as in the preferred embodiment.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

I claim:

1. A safety enclosure cover for, and in combination with, a portable air-inflatable swimming pool comprising:

a mat spread on a horizontal surface;

a pool resting on said mat with an outer rim of said mat extending beyond an outer wall of said pool;

said pool containing water;

an inflated holding pillow floating on an upper surface of said water;

a cover enclosing said pool and said holding pillow; and means for attaching an outer edge of said cover to an outer edge of said mat whereby said water and pool are completely enclosed, said cover thereby being formed into a convex shape whereby rainwater is shed from said cover.

2. The combination of claim 1 in which said pool has an inflatable wall, and means to inflate said wall.

3. The combination of claim 2 having means for inflating said pillow through said cover.

4. The combination of claim 3 in which said means for inflating said pillow comprises an air line from said pillow to a fill valve mounted on a dome section of said cover, and an air pump for delivering air through said fill valve and air line to said pillow.

5. The combination of claim 4 in which said fill valve comprises a removable cap to allow deflation of said pillow.

6. The combination of claim 1 in which said attaching means comprises a zipper.

7. The combination of claim 6 having a lock to maintain said zipper in a closed position.

8. A method of enclosing a portable air-inflatable swimming pool comprising the steps of:

spreading a mat on a horizontal surface;

resting a pool on said mat with an outer rim of said mat extending beyond an outer wall of said pool;

filling said pool with water;

placing an inflated holding pillow on an upper surface of said water;

using a cover to enclose said pool and said holding pillow; and attaching an outer edge of said cover to an outer edge of said mat whereby said water and pool are completely enclosed, said cover thereby being formed into a convex shape whereby rainwater is shed from said cover.

9. The method of claim 8 in which said pool has an inflatable wall, and said wall is inflated.

10. The method of claim 8 in which a zipper is employed to attach said cover to said mat.

11. The method of claim 10 in which a lock is used to maintain said zipper in a closed position.

12. The method of claim 8 in which said cover and mat are cut and pieced together from a single strip of flexible material.

13. A method of enclosing a portable air-inflatable pool comprising the steps of:

spreading a mat on a horizontal surface;

resting a pool on said mat with an outer rim of said mat extending beyond an outer wall of said pool;

filling said pool with water;

using a cover with a holding air pillow attached to the underside of said cover to enclose said pool and said holding pillow;

attaching an outer edge of said cover to an outer edge of said mat whereby said water and pool are completely enclosed, and inflating said air pillow, said cover thereby being formed into a convex shape whereby rainwater is shed from said cover.

14. The method of claim 13 in which said pillow is inflated through said cover.

15. The method of claim 14 in which said pillow is inflated through an air line from said pillow to a fill valve mounted on a dome section of said cover, and an air pump delivering air through said fill valve and air line to said pillow.

16. The method of claim 15 in which said pillow is deflated by removing a removable cap on said fill valve.

17. The method of claim 13 in which a zipper is employed to attach said cover to said mat.

18. The method of claim 17 in which a lock is used to maintain said zipper in a closed position.

19. The method of claim 13 in which said cover and mat are cut and pieced together from a single strip of flexible material.

* * * * *